US007752723B2

(12) United States Patent
Bertsch

(10) Patent No.: US 7,752,723 B2
(45) Date of Patent: Jul. 13, 2010

(54) NOZZLE CORE FOR A DEVICE USED FOR PRODUCING LOOP YARN AS WELL AS METHOD FOR THE PRODUCTION OF A NOZZLE CORE

(75) Inventor: Gotthilf Bertsch, Ebnat-Kappel (CH)

(73) Assignee: Oerlikon Heberlein Temco Wattwil AG, Wattwil (CH)

( * ) Notice: Subject to any disclaimer, the term of this patent is extended or adjusted under 35 U.S.C. 154(b) by 791 days.

(21) Appl. No.: 10/558,616

(22) PCT Filed: Apr. 1, 2004

(86) PCT No.: PCT/CH2004/000202

§ 371 (c)(1),
(2), (4) Date: Dec. 7, 2006

(87) PCT Pub. No.: WO2004/106605

PCT Pub. Date: Dec. 9, 2004

(65) Prior Publication Data

US 2007/0107410 A1 May 17, 2007

(30) Foreign Application Priority Data

May 27, 2003 (CH) ..... 946/03

(51) Int. Cl.
*D02J 1/08* (2006.01)
*D02G 1/16* (2006.01)

(52) U.S. Cl. ..... 28/271; 28/254

(58) Field of Classification Search ..... 28/271, 28/274, 276, 275, 272, 273, 254, 257; 57/908, 57/350

See application file for complete search history.

(56) References Cited

U.S. PATENT DOCUMENTS 3,389,444 A * 6/1968 Fletcher et al. ..... 28/274

(Continued)

FOREIGN PATENT DOCUMENTS

DE 3927910 2/1991

(Continued)

OTHER PUBLICATIONS

English Translation of International Preliminary Report on Patentability, dated Apr. 6, 2006.

(Continued)

*Primary Examiner*—Amy B Vanatta
(74) *Attorney, Agent, or Firm*—Shoemaker and Mattare

(57) ABSTRACT

The invention relates to a ceramic nozzle core and a method for producing a ceramic nozzle core which is part of a device used for producing loop yarn. The inventive ceramic nozzle core is embodied with an approximately constant wall thickness and a reduced size so as to perform the central functions of the yarn processing duct comprising air injection and a yarn outlet for forming loops while being produced in a molding process. In a particularly preferred method, the ceramic nozzle core is injection-molded with high precision. The inventive ceramic nozzle core can be configured in a miniaturized fashion and as part of a two-piece nozzle core, the ceramic nozzle core being inserted into an outer nozzle core jacket. The two-piece nozzle core can be incorporated into a housing known in prior art, for example, as a replaceable nozzle core.

10 Claims, 6 Drawing Sheets

U.S. PATENT DOCUMENTS

Figure 1:
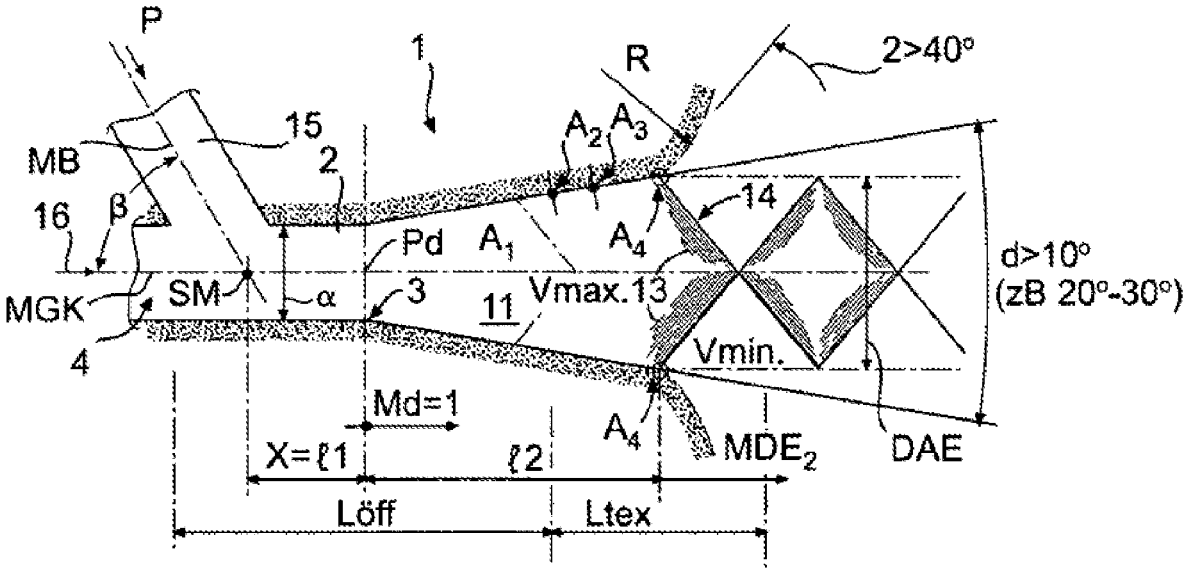

| | | | | |
|---|---|---|---|---|
| 4,507,833 | A | 4/1985 | Simmen et al. | |
| 4,945,718 | A * | 8/1990 | Stahlecker et al. | 57/333 |
| 5,119,623 | A | 6/1992 | Fetzer et al. | |
| 5,326,009 | A * | 7/1994 | Kobayashi et al. | 226/97.4 |
| 5,423,859 | A * | 6/1995 | Koyfman et al. | 606/228 |
| 5,481,787 | A * | 1/1996 | Sano et al. | 28/276 |
| 5,640,745 | A | 6/1997 | Bertsch et al. | |
| 6,088,892 | A | 7/2000 | Bertsch et al. | |
| 6,134,759 | A * | 10/2000 | Saijo et al. | 28/274 |
| 6,564,438 | B1 | 5/2003 | Bertsch et al. | |
| 7,260,875 | B2 * | 8/2007 | Stundl et al. | 28/258 |

FOREIGN PATENT DOCUMENTS

| | | | |
|---|---|---|---|
| DE | 195 80 019 | C1 | 9/1996 |
| EP | 0 088 254 | A2 | 9/1983 |
| EP | 0 088 254 | B1 | 9/1983 |
| EP | 1022366 | A2 | 7/2000 |
| EP | 0 880 611 | B1 | 8/2001 |
| EP | 1 058 745 | B1 | 2/2002 |
| JP | 3193905 | | 8/1991 |
| JP | 6200448 | | 7/1994 |
| JP | 11315440 | | 11/1999 |
| JP | 2001159044 | | 6/2001 |
| JP | 2006160446 | | 6/2006 |
| WO | WO 97/30200 | | 8/1997 |
| WO | WO 99/45182 | | 9/1999 |

OTHER PUBLICATIONS

International Search Report, Mailed Oct. 7, 2004.

* cited by examiner

FIG. 6A
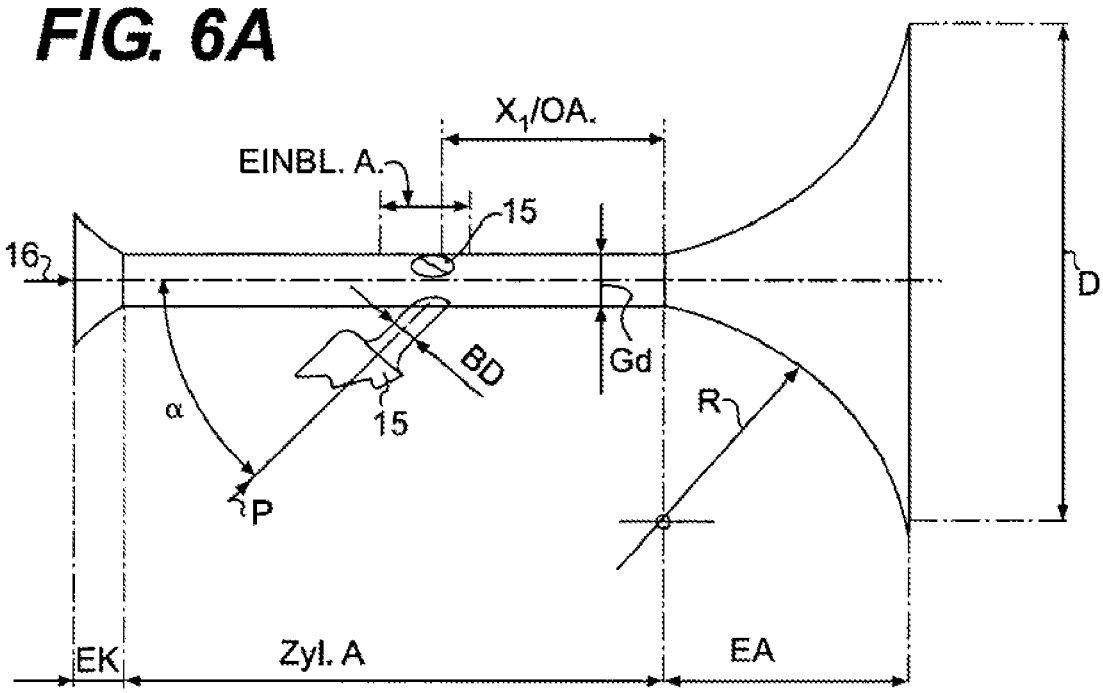
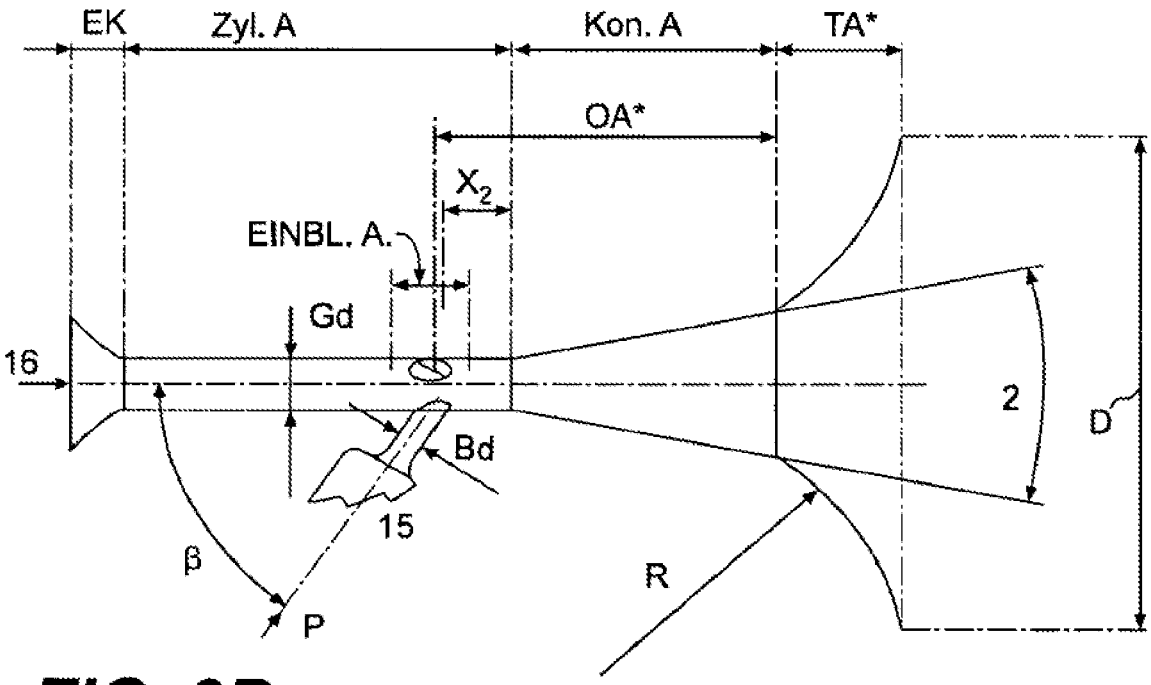
FIG. 6B

NOZZLE CORE FOR A DEVICE USED FOR PRODUCING LOOP YARN AS WELL AS METHOD FOR THE PRODUCTION OF A NOZZLE CORE

TECHNICAL AREA

The invention relates to a method for producing a ceramic nozzle core as part of a device to produce loop yarn, as well as a nozzle core for a device used for producing loop yarn.

STATE OF THE ART

The term "texturing" in part still relates to the finishing of spun bundles of filaments and/or the corresponding continuous yarns, with the goal of lending the yarn a textile character. In the following description, the term "texturing" relates to the production of a number of loops on individual filaments and/or the production of loop yarn. An older solution for texturing is described in EP 0 088 254. The continuous filament yarn is supplied to the yarn guide duct at the entry end of a texturing nozzle and textured at a trumpet-shaped outlet end by the impact forces of a supersonic flow. The yarn guide duct is cylindrical and has a constant diameter. The entry is slightly rounded to introduce the untreated yarn without any problems. There is a draw bar at the trumpet-shaped outlet end, with the formation of loops occurring between the trumpet form and the drawbar. The yarn is supplied to the texturing nozzle with excess delivery. The excess delivery is required for the formation of loops at each individual filament, which results in an increase of the titer at the output end.

EP 0 088 254 proceeded from a device for the texturing of at least one continuous yarn comprised of a plurality of filaments. The nozzle has a yarn guide duct as well as at least one feed for the pressure medium, which runs into the duct in radial direction. The generic nozzle had a duct outlet opening that tapered toward the outside and a spherical and/or semi-spherical draw bar that projected into the outlet opening, and formed a ring gap with the same. It was found that with textured yarns, retaining the properties of the yarn during the processing process as well and after the processing process on the finished product is an important criterion for the application of these yarns. Furthermore, the mixing of two or more yarns and the individual filaments of the textured yarns is of significant importance for obtaining a uniform product. The stability is used as criterion for quality.

To determine the instability I of the yarn, small strands of yarn with four coils of 1 meter circumference each are formed on a reel, as is explained with the example of multi-filament yarn on polyester with the titer 167f68 dtex. These small strands are then stressed for one minute at 25 cN, and then the length X is determined. This is followed for another minute with a stress of 1250 cN. After relieve, the strand is again stressed a minute later at 25 cN, and after another minute, the length y is determined. This results in the value of the instability:

$$I = \frac{Y \cdot X}{X} \cdot 100\%$$

The instability indicates the percentage of lasting elongation caused by the applied stress. EP 0 088 254 was then based on the problem to create an improved device of the type mentioned above, which can be used to obtain an optimum texturing effect that ensures a high stability of the yarn as well as a high degree of mixing of the individual filaments. As a solution, it was proposed that as optimum results the outer diameter of the convexly arched outlet opening of the duct is at least equal to four times the diameter of the duct and at least equal to 0.5 times the diameter of the spherical- and/or semi-spherical draw bar. Production speeds in a range of 100 to over 600 meters per minute were determined. What is interesting is the fact that the applicant was able to successfully market these nozzles for a period of more than 15 years. The quality of the yarns produced with said nozzles was considered very good for one and a half decades. However, there was a growing desire for greater performance. With the solution according to EP 0 880 611, the applicant was able to achieve a massive increase in performance up to far above 1000 meters per minute of yarn transport speed. The core idea for the increase in performance was in an intensification of the flow conditions in the expanding ultrasound duct, i.e., in the zone where the loops are formed. The tension of the yarn at the output of the texturing nozzle was recognized as special testing criterion. Many testing series revealed that with the solution according to EP 0 088 254, the yarn tension drops sharply after a yarn transport speed of approximately 600 m per minute. In the end, this is the explanation for the performance limitations of these types of nozzles. The recommendation in EP 0 880 611, to intensify the flow in the supersonic duct, results in an unexpected increase in the yarn tension, which allowed an increase of the transport speed to over 1000 m per minute. The quality of the yarn processed in this way was initially assessed as equal, if not even better, even at the highest transport speeds. In practice, however, there were some surprises afterwards because in many applications the quality of the yarn did not correspond to the desired demands after all.

In EP 0 880 611 it was realized that the first key for quality lies in the tension of the yarn following the texturing nozzle. Only if it is possible to increase the yarn tension, it is possible to improve the quality. The breakthrough was made possible when the flow of the blast jet was increased to above the range Mach 2. Many series of experiments have confirmed that not only is there an improvement in the quality, but that an increase in the production speed has surprisingly little negative impact on the quality. Even a slight increase of the Mach number above 2 already produced significant results. The best explanation for the corresponding intensification of the texturing process is seen in that the difference in speed is increased directly before and after the shock front, which has a direct effect on the corresponding air attack forces on the filaments. The increased forces in the area of the shock front cause an increase in the yarn tension. By increasing the Mach number, the events at the shock front are directly increased. In accordance with the invention, the following rule was recognized: higher Mach number=greater shock=more intensive texturing. The intensified supersonic flow takes hold of the individual filaments of the opened yarn on a wider front and with much more intensity so that loops cannot escape laterally through the effective zone of the shock front. Because generating the supersonic flow in the acceleration duct is based on the expansion, a higher Mach range, for example Mach 1.5, Mach 2.5, results in an increase and/or nearly a doubling of the effective output diameter. Various surprising observations were made and confirmed in combination with the new invention:

The comparative experiments, state of texturing technology according to EP 0 088 254, and the solution in the scope of EP 0 880 611, resulted in the following rule in a considerably wide area: The texturing quality is at least the same or better at a higher production speed compared to the texturing quality at lower production speed with a supersonic duct designed for the lower Mach range. With air speeds in the shock front of above Mach 2, for example at Mach 2.5 to Mach 5, the texturing process is so intensive that even at the highest yarn throughput speeds, nearly all loops are captured without exception and integrated well in the yarn. Generating an air speed in the high Mach range within the acceleration duct effects that the texturing no longer collapses even at the highest speeds. Secondly, the entire filament composite is guided evenly and directly into the shock front zone within clear outer duct limits.

In the acceleration duct, the yarn is pulled in by the accelerating air jet over the appropriate path, opened farther, and then transferred directly to the subsequent texturing zone. The blast air jet is then guided to the acceleration duct without redirection through a segment that widens unsteadily and strongly. One or a plurality of yarn threads can be inserted at the same or different delivery and textured at a production speed of 400 to 1200 meters per minute. The compressed air jet in the supersonic duct is accelerated to 2.0 to 6 Mach, preferably to 2.5 to 4 Mach. The best results are obtained if the end of the yarn duct at the output side is delimited by a deflector. The textured yarn is discharged through a gap at an approximately right angle relative to the yarn duct axis.

The entire theoretically effective expansion angle of the supersonic duct should be more than 10°, but less than 40°, preferably between 15° to 30° from the smallest to the largest diameter. According to the currently applicable roughness values, the uppermost limiting angle (total angle) relative to the series production is 35° to 36°. In a conical acceleration duct, the compressed air is essentially accelerated steadily. The nozzle duct segment directly before the supersonic duct is preferably designed approximately cylindrically, with the conveyer component being blown into the cylindrical segment in direction of the acceleration duct. The introduction force on the yarn is increased with the length of the acceleration duct. The nozzle enlargement and/or the increase of the Mach number results in the intensity of the texturing. The acceleration duct should have at least one cross-sectional enlargement area of 1:2.0, preferably 1:2.5 or greater. It is furthermore proposed that the length of the acceleration duct is 3 to 15 times greater, preferably 4 to 12 times greater, than the diameter of the yarn duct at the beginning of the acceleration duct. The acceleration duct can be designed to expand completely or in part steadily, it can have conical segments, and/or it can have a slightly spherical form. However, it is also possible to develop the acceleration duct in fine steps and it can have different acceleration zones, with at least one zone with great acceleration and at least one zone of small acceleration of the compressed air jet. If the aforementioned parameters for the acceleration duct were maintained, the aforementioned variations of the acceleration duct proved to be nearly equal in value or at least equivalent. Downstream of the supersonic duct, the yarn duct has a strongly convex, preferably trumpet-shaped yarn duct orifice that is enlarged by more than 40°, with the transition from the supersonic duct into the yarn duct orifice preferably being intermittent. A decisive factor was also found in that a deflector can positively influence and stabilize the pressure conditions in the texturing space. Another preferred embodiment of the texturing nozzle is characterized in that it has a continuous yarn duct with a cylindrical center segment into which the air feed runs.

All earlier experiments only confirmed that for the data determined with texturing nozzles with radial air blast into the yarn duct according to EP 0 088 254, the optimal injection angle for the treatment air is around 48°. As a compete surprise, it was found with the latest experiments that the enlargement of the injection angle with nozzles in accordance with EP 0 880 611 already led to an unexpected increase in the quality of the textured yarn in the first series of experiments. Thereafter, the inventors realized that the two process zones, the opening of the yarn, and the texturing of the yarn are core characteristics and must be optimally coordinated relative to one another. Repeated experiments have shown that with the solution in accordance with EP 0 088 254, the limitation is in the texturing zone and therefore, an increase of the yarn opening will only prove disadvantageous.

From the area of yarn interlacing, which is not an object of the present application, it is known that the yarn opening effect is greatest at an injection angle of 90°. The objective of the interlacing is to form regular knots in the yarn. For an example of interlacing, reference is made to DE 195 80 019. With textured yarn, however, knots are absolutely undesired. There is a limit for the injection angle for the two principally different processes of the formation of knots and the formation of loops. From the various functions for obtaining the highest yarn qualities, even at the highest yarn transport speeds, an unexpected increase was achieved, which is described in detail in the following. At least from the view of the applicant, it was seen as a huge disadvantage that the production of the so-called nozzle cores required high-effort production processes. All attempts with more economic procedures, such as the pressing or injection moulding, for example, failed. In the scope of the allowances, it was not possible to produce acceptable blanks, either in the press- or in the injection molding process. The reason for this was in the specifics of the material, i.e., ceramic. Ceramic is still one of the best materials in view of wear-and-tear and/or resistance.

The new invention was then based on attaining the objective to ensure, on the one hand, all of the known advantages of the described nozzle cores, while on the other hand, develop new production methods that allow an economical production of the nozzle cores.

EXPLANATION OF THE INVENTION

The method in accordance with the invention is characterized in that the ceramic nozzle core is designed with nearly constant wall strength and its size is reduced to the central functions of the yarn treatment duct with air injection and yarn outlet for the formation of loops, and that it is produced in the molding process.

A very advantageous embodiment is characterized in that the ceramic nozzle core is injection molded in the high precision process.

The nozzle core in accordance with the invention is characterized in that it is developed as a ceramic nozzle core with approximately constant wall strength, that its size is reduced to the central functions of the yarn treatment duct with air injection and yarn outlet for the formation of loops, and that it can be produced in the molding process.

Until now, the applicant proceeded on the assumption that an important criterion for any new development is to develop the nozzle core as a replaceable core so that a nozzle core with other internal dimensions and air inlet angles can be inserted. This makes it possible, for example, to replace an existing state of the art nozzle core with only a few manipulations and to use all advantages of the new development. Only now has the inventor realized that this requirement, which in itself is a positive one, was taken too literal in past developments and strongly inhibited the further development. Consequently, any new nozzle core was developed with outer dimensions that were identical to the old nozzle cores. As a result, the blanks for the nozzle core increasingly could not be produced in the injection- or pressing process any more, and/or the conditions for a production in the molding process became increasingly less favorable. The new invention has let go of the literal urge to develop the ceramic nozzle core as a replacement core. Rather, the development is geared consequently toward the interior central functions. The entire structure can now be determined according to the requirements of injection molding technology and developed, for example, by a division into two, as a ceramic nozzle core in miniaturized fashion with an outer ceramic nozzle jacket. Only the outer jacket receives the dimensions of the nozzle cores of the state of the art, which also take over the function of the replacement core.

The new invention allows a number of especially advantageous embodiments, with reference being made to the claims 4 to 10. An especially advantageous embodiment is characterized in that the yarn treatment duct has at least one cylindrical segment as well as an enlarged segment, with the air injection being arranged within the cylindrical segment, preferably approximately in the center area of the longitudinal side of the ceramic nozzle core. According to EP 0 088 254, the enlarged segment can be developed completely in trumpet-shape, or according to EP 0 880 611 it can have a conical as well as a trumpet-shaped segment. The yarn duct has a center segment, which is preferably cylindrical and transitions into the conical enlargement in transport direction without jump, with the compressed air being blown into the cylindrical segment with sufficient distance to the conically enlarged supersonic duct. The experiments in connection with the new invention revealed several new findings:

With texturing nozzles with intensified supersonic flow according to EP 0 880 611, a quality improvement could be achieved with each yarn titer if the air injection angle was increased to over 48°. The increase in quality begins with a clear-cut rise when the angle is enlarged to over 50°. The yarn quality remains surprisingly stable at air injection angles greater than 52°, partially to 60° and even to 65°. However, the optimum injection angle also depends on the yarn titer.

Preferably, the compressed air is blown into the yarn duct through three borings offset by 120° on the circumference. In any case, what is important is that the opening of the yarn intensifies because of the compressed air being blown into the yarn duct, but that the formation of knots in the yarn is avoided. The opening of the yarn on the one side as well as the texturing of the yarn on the other side must be optimized individually. To optimize these two completely different functions, they have to be separated locally, but performed quickly one after the other so that the texturing follows directly after the opening, and/or that the ending of the yarn opening process directly transitions into the texturing. All central texturing functions for the production of a loop yarn can now be realized within a ceramic nozzle core in miniaturized fashion. The new ceramic nozzle core may be part of a device that has a spherical deflector which can be lowered into the enlargement segment, with the trumpet-shaped segment having a radius that is relative to the diameter of the deflector. Preferably, according to EP 0 088 254, the deflector and the trumpet-shaped segment form a ring gap, with the outer diameter of the convexly arched output opening of the duct being at least equal to four (4) times the diameter of the duct and at least equal to 0.5 times the diameter of the spherical- and/or semi-spherical drawbar.

It is in particular preferred if the nozzle core is designed in two parts and has an outer nozzle body into which the ceramic nozzle core can be inserted, with the outer nozzle body being made of synthetic material. The outer body made of synthetic material then has the function of a replacement body in the previous sense with the required installation dimensions and fastening means. Preferably, a nip is arranged between the outer nozzle body and the ceramic nozzle core to fasten the ceramic nozzle core in the outer nozzle body. Furthermore, an annular compressed air duct is arranged between the ceramic nozzle core and the nozzle body in the area of the cylindrical segment, through which the air is blown in by means of the blow-in borings. The annular compressed air duct has in both end areas of the cylindrical segment one each seal to seal the compressed air.

According to a further embodiment, the nozzle core is designed as a quick replacement element inside the device, so that it can be installed in and removed from the device quickly together with the ceramic nozzle core. The nozzle core can be designed in two parts, with an inner ceramic nozzle core and an outer nozzle body, with both parts being one device with rotary actuator, and the nozzle body being driven with the installed ceramic nozzle core.

In the two-part solution, the ceramic nozzle core and the outer nozzle body form an approximately planar surface at the yarn output end in assembled condition. According to an important requirement of the new solution, the design of the nozzle body is supposed to compensate variations in form and thickness. The structural requirements in view of the assembly and the installation into a machine can be compensated in this manner by the outer nozzle body. The ceramic nozzle core can be designed optimally with respect to the production of ceramic blanks. Especially preferably, the nozzle body is produced as an injection molded part and developed in the outer dimensions as a replacement part with respect to corresponding solutions in the state of the art.

The new invention proceeds from the generic texturing nozzles according to the radial principle. In the radial principle, the blast air is guided from the in-feed location in a cylindrical segment of the yarn duct directly into an axial direction at approximately constant speed up to the acceleration duct. As in the state of the art of EP 0 880 611, the new solution also allows the texturing of one or a plurality of yarn threads with varying delivery.

BRIEF DESCRIPTION OF THE INVENTION

Figure 2:
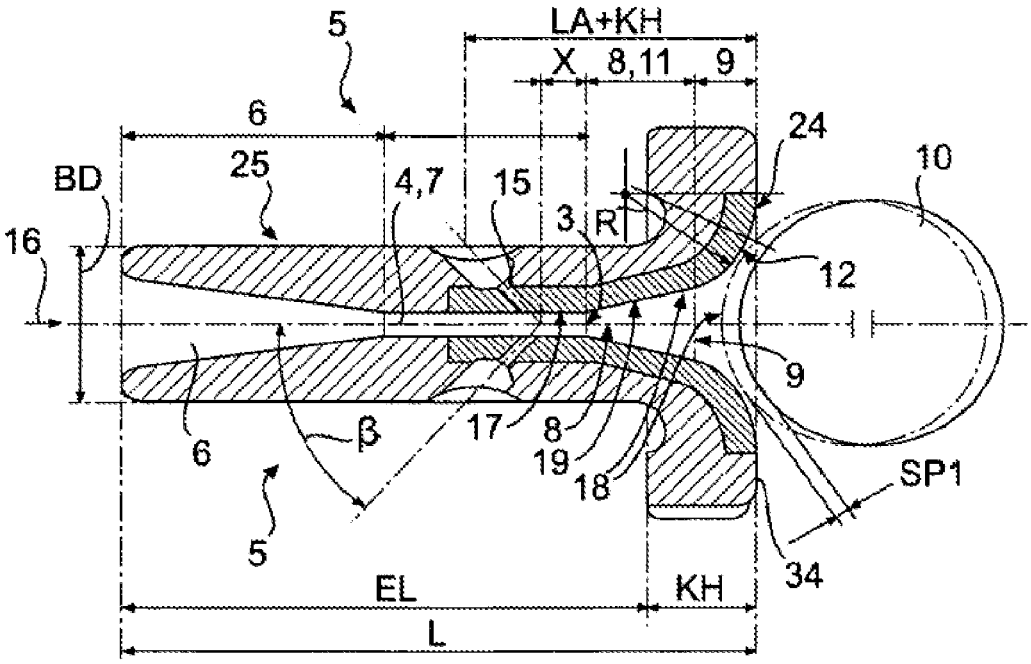
Figure 3:
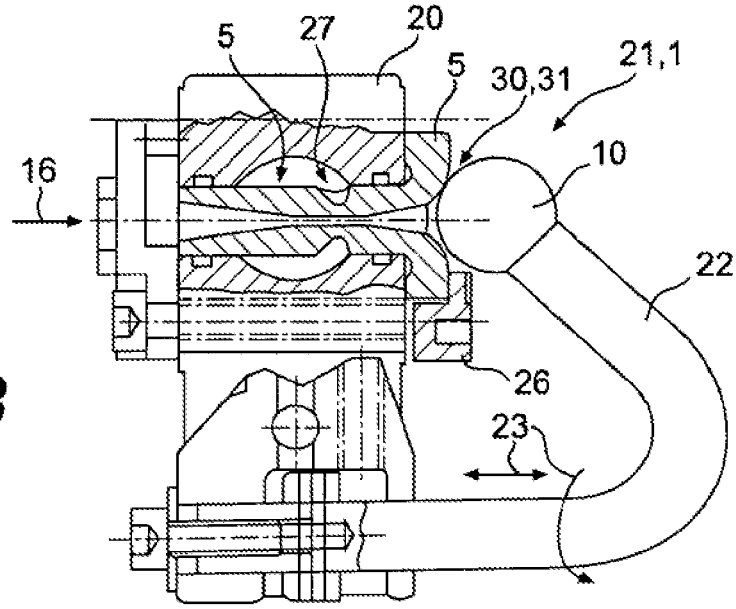
Figure 4A:
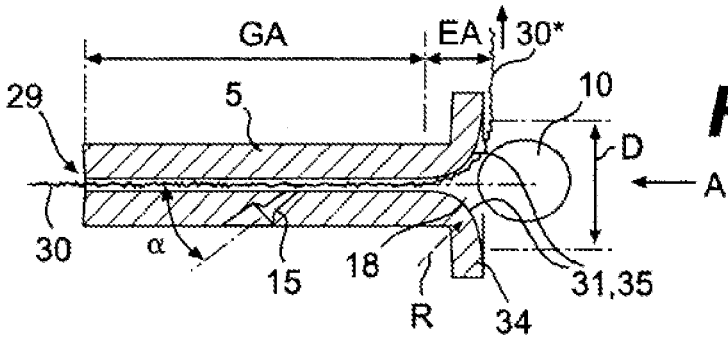
FIG. 4A (PRIOR ART)
Figure 4B:
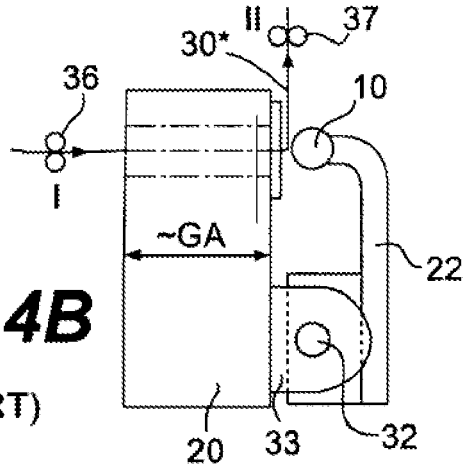
FIG. 4B (PRIOR ART)
Figure 4C:
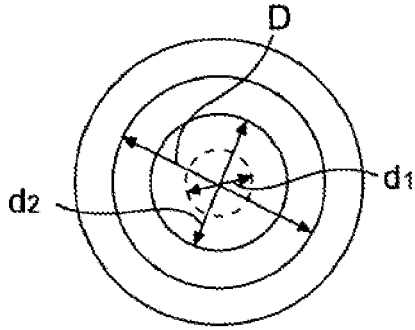
FIG. 4C (PRIOR ART)
Figure 5:
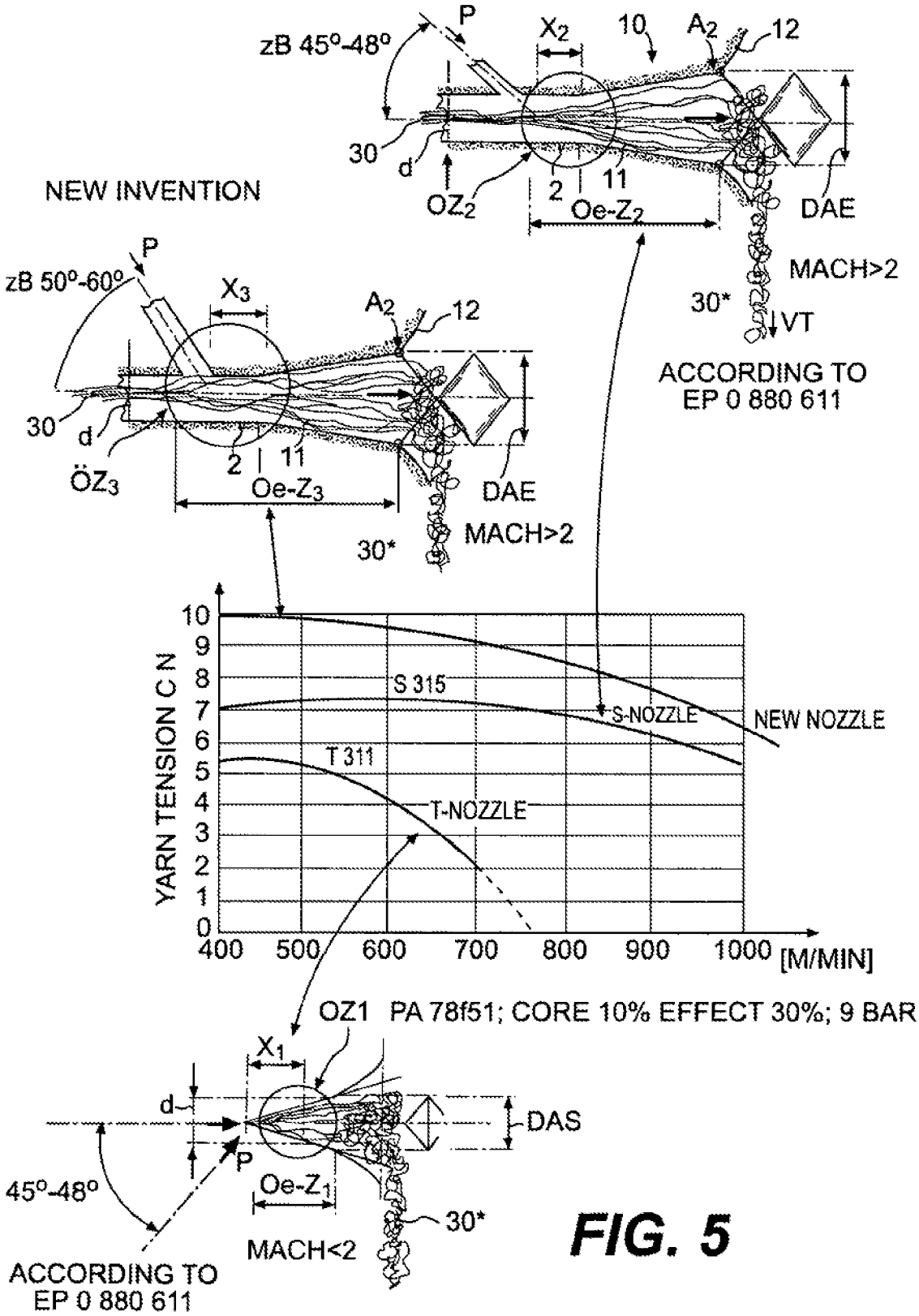
Figure 7:
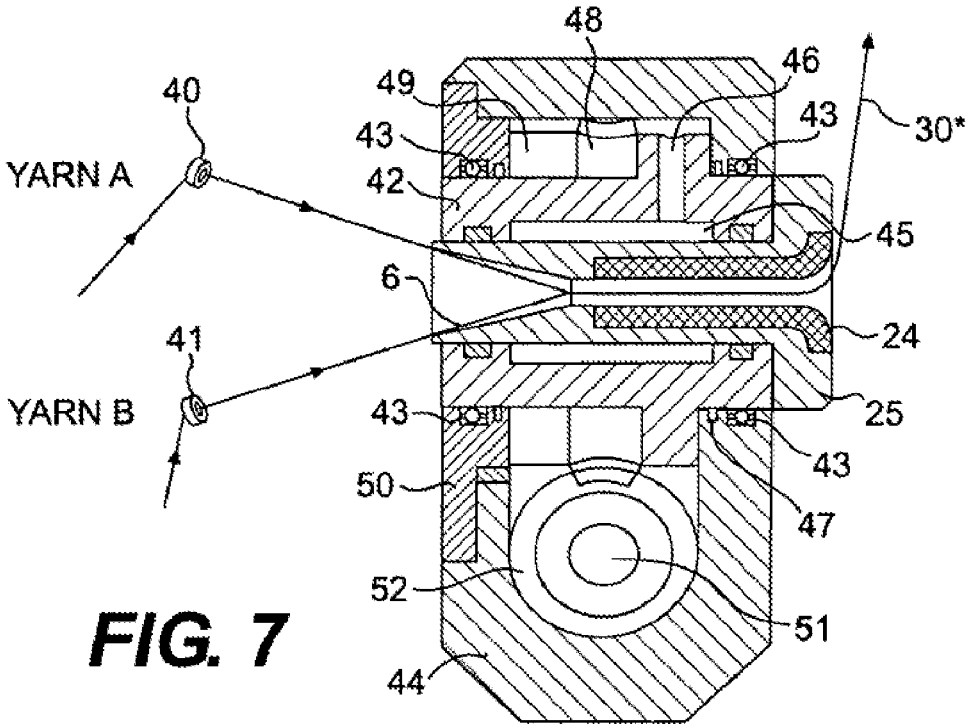
Figure 8:
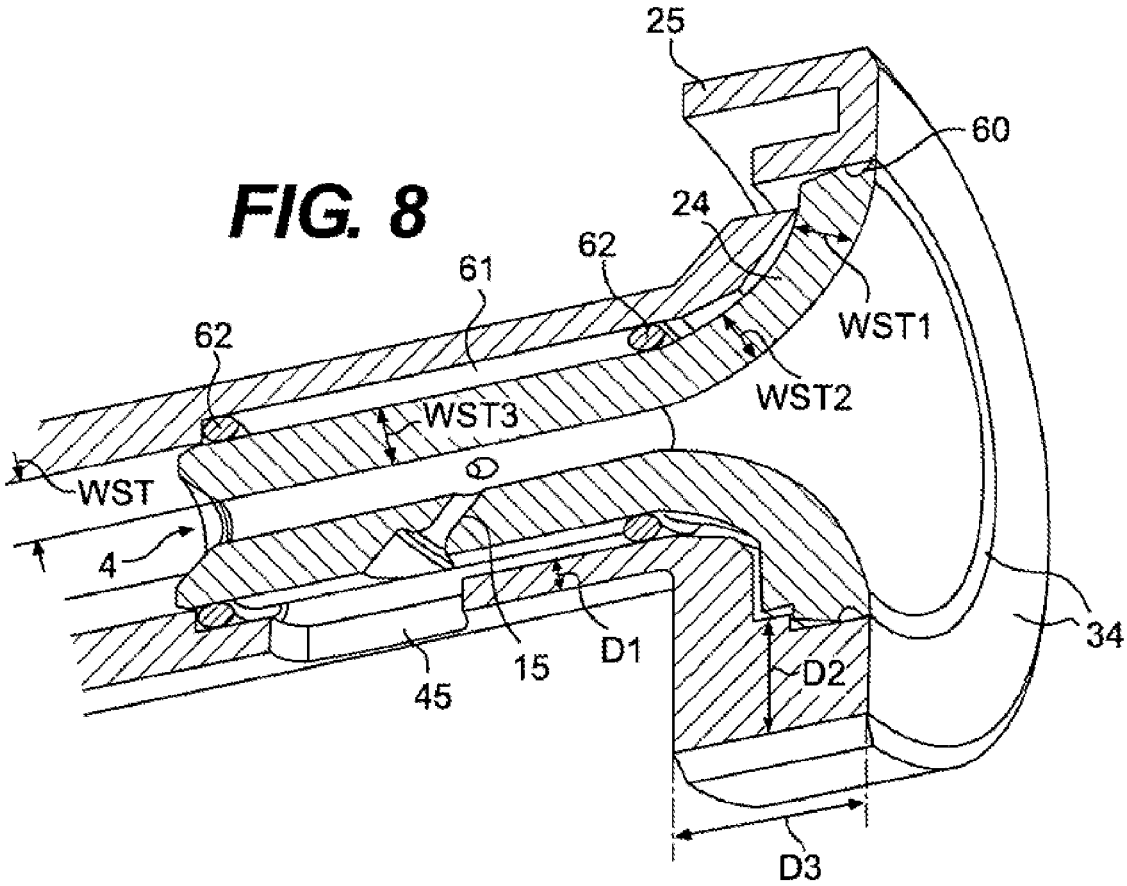
Figure 9:
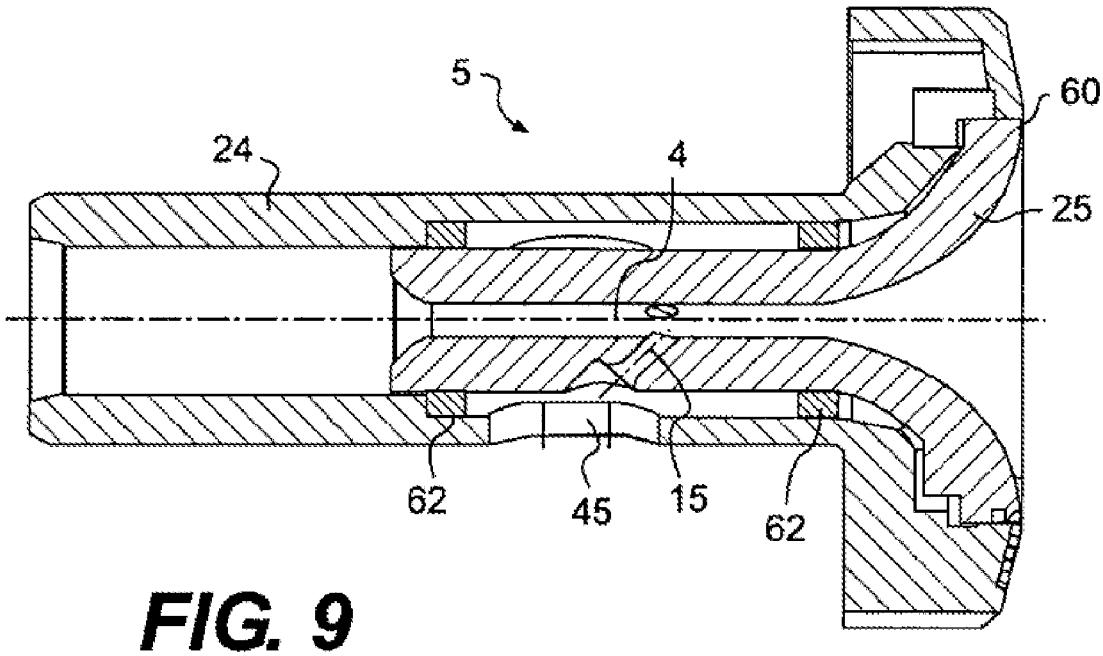
Figure 10:
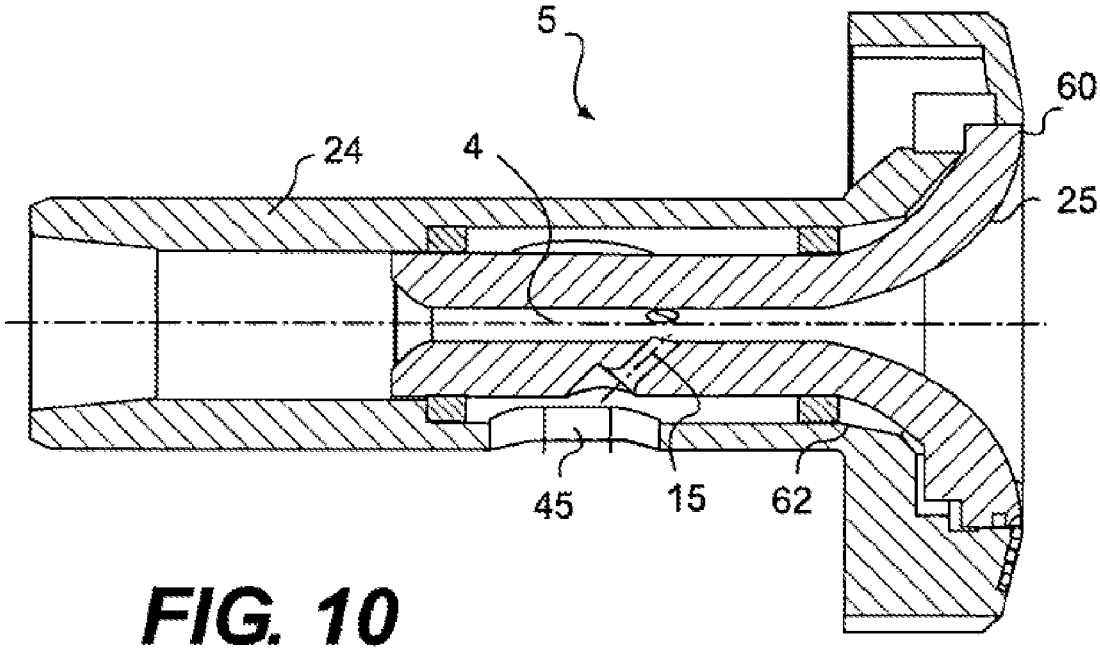

The invention is shown in detail in the following by means of several examples. Shown are:

In FIG. 1 the yarn duct in the area of the yarn opening- and texturing zone;

In FIG. 2 a nozzle core with inserted ceramic nozzle core as well as a deflector at the output end of the yarn duct;

In FIG. 3 a two-part nozzle core, installed into a device for generating loop yarn;

In FIGS. 4*a*, 4*b* and 4*c* a solution in accordance with the state of the art (EP 0 088 254) with a nozzle core, with the FIG. 4*c* being a view according to arrow A;

in FIG. 5 a comparison of textured yarn with various embodiments of the nozzle core;

In FIGS. 6*a* and 6*b* the "frame" for the core functions for generating loop yarn;

In FIG. 7 a solution with a rotatably driven nozzle core;

In FIG. 8 a 3-D representation with a divided and/or two-part nozzle core, with an outer nozzle core jacket as well as a ceramic nozzle core;

In FIG. 9 a section through a two-part nozzle core corresponding to the FIGS. 6*a* and 8;

In FIG. 10 a section of a two-part nozzle core corresponding to FIGS. 6*b* and 8.

WAYS AND EXECUTION OF THE INVENTION

The following refers to FIG. 1. The texturing nozzle 1 has a yarn duct 4 with a cylindrical segment 2, which simultaneously also corresponds to the narrowest cross-section 3 with a diameter d. From the narrowest cross-section 3, the yarn duct 4 transitions into an acceleration duct 11 without cross-section jump and is then enlarged in trumpet-shape, with the trumpet shape being defined by a radius R. Because of the ensuing supersonic flow, a corresponding shock front diameter $DA_E$ can be determined. Because of the shock front diameter $DA_E$, the detachment- or tearing location $A_1$, $A_2$, $A_3$ or $A_4$ can be determined with relative precision. Reference is made to EP 0 880 611 for the effect of the shock front. The acceleration range of the air can also be defined by the length $l_2$ from the location of the narrowest cross-section 3 as well as the tearing location A. Because this is a genuine supersonic flow, the approximate air speed can be calculated therefrom. FIG. 1 shows a conical embodiment of the acceleration duct 11, which corresponds to the length $l_2$. The opening angle $\alpha_2$ is given as 20°. The detachment location $A_2$ is illustrated at the end of the supersonic duct where the yarn duct transitions into an unsteady, strongly conical or trumpet-shaped enlargement 12 with an opening angle ∂>40°. Because of the geometry, the resulting shock front diameter is $D_{AE}$. For example, the following conditions are obtained:

$$L2/d = 4.2;$$

$$Vd = 330 \text{ m/sec (Mach 1)};$$

$$\frac{DAE}{d} \sim 2.5 \rightarrow M_{DE} = \text{Mach } 3.2$$

An extension of the acceleration duct 11 with appropriate opening angle effects an enlargement of the shock front diameter $D_{AE}$. Directly in the area of the formation of the shock front, the largest possible densification shock front 13 with subsequent abrupt pressure increase zone 14 is created. The actual texturing occurs in the area of the densification shock front 13. The air moves faster than the yarn by a factor of approximately 50. With many experiments, it was determined that the detachment location $A_3$, $A_4$ may also travel into the acceleration duct 11, i.e., specifically if the feed pressure is lowered. In practice, the optimal feed pressure for each yarn must therefore be determined, with the length (l2) of the acceleration duct being designed for the unfavorable case, i.e., it is selected a bit too long. $M_B$ denotes the center line of the injection boring 15, $M_{GK}$ denotes the center line of the yarn duct 4, and SM denotes the section of $M_{GK}$ and $M_B$. Pd is the location of the narrowest cross-section at the beginning of the acceleration duct 11, l1 is the distance between SM and Pd, l2 is the distance from Pd to the end of the acceleration duct (A4). Löff denotes approximately the length of the yarn opening zone, Ltex approximately the length of the yarn texturing zone. The yarn opening zone is enlarged backwards in proportion to the size of the angle β.

The following now refers to FIG. 2, which shows a preferred embodiment of the entire nozzle core 5 in cross-section. The outer fit is preferably adapted exactly to the nozzle cores of the state of the art. This relates in particular to the critical installation mass, the boring diameter $B_D$, the total length L, the nozzle head height $K_H$ as well as the distance $L_A$ for the compressed air connections PP. The experiments have shown that an injection angle β greater than 48° is optimal. The distance X of the corresponding compressed air borings 15 is critical with respect to the acceleration duct. The nozzle core 5 has a yarn introduction cone 6 in the entry area of the yarn (arrow 16). The measure "X" (FIG. 6) shows that the compressed air boring 15 is preferably backset from the narrowest cross-section 3 by at least the size of the diameter d. When viewed in the direction of transport (arrow 16), the texturing nozzle 1 and/or the nozzle core 5 have a yarn introduction cone 6, a cylindrical center segment 7, a cone 8 that simultaneously corresponds to the acceleration duct 11, as well as an enlarged texturing space 9. The texturing space is delimited by a trumpet form 12 transverse to the flow, which also can be developed as an open conical feeder.

FIG. 2 shows, in multiple enlargement relative to the actual size, a two-part nozzle core 5, comprised of a ceramic nozzle core 24 as well as an outer nozzle core jacket 25 with a drawbar or deflector 10. The new nozzle core 5 can be designed as a replacement core for a nozzle core of the state of the art. In particular the dimensions $B_d$, $E_L$ as installation length, $K_A$+$K_H$ as well as $K_H$ are therefore preferably produced not only the same, but also with the same tolerances. Preferably, the trumpet form in the outer outlet area is also produced as in the state of the art, with a corresponding radius R. The deflector 10 may have any form: spherical, ball-shaped, flat or even in the sense of a spherical surface. The precise position of the deflector in the outlet area is retained by maintaining the outer dimensions, including an equal escape gap $S_{P1}$. The texturing space 18 is delimited in the back by the acceleration duct 11. Depending on the height of the selected air pressure, the texturing space may also be enlarged into the acceleration duct. As in the state of the art, the ceramic nozzle core 24 is produced on the whole from a high-quality material such as ceramic and is the actual expensive part of a texturing nozzle. What is important with the new nozzle is that the conical cylindrical wall surface 17 as well as the wall surface 19 in the area of the acceleration duct and the orifice location of the compressed air borings 15 in the yarn duct are of the highest quality.

FIG. 3 shows a complete nozzle head 21 with a two-part nozzle core 5 as well as a deflector 10 that can be adjusted through an arm 22 and is anchored in a known housing 20. For the threading, the deflector 10 and the arm 22 are pulled and/or pivoted away from the working area of the texturing nozzle in the known manner according to the arrows 23. The compressed air is supplied through compressed air borings 15 from a housing chamber 27. The nozzle core 5 is clamped into place at the housing 20 by a clamping bride 26. Instead of a spherical form, the deflector can also have the form of a spherical surface.

FIGS. 4*a*, 4*b* and 4*c* show a solution in accordance with the state of the art corresponding to EP 0 088 254, with a long yarn guide duct 29 through which the yarn 30 to be textured runs. The yarn guide duct 29 is supplied with compressed air by a radial compressed air boring 15. With the axis of the yarn guide duct 29, the injection boring 15 encloses an angle α of approximately 48°. The diameter of the injection boring 15 is 1.1 mm. The yarn guide duct 29 has a diameter $d_1$ of 1.5 mm and a convexly curved outlet opening that enlarges toward the outside. The convex curvature has the form of a circular arc with a radius R of 6.5 mm, with the end face 34 of the texturing nozzle 1 forming a tangential plane relative to said circular arc, and with the contact points of the curved arc and the tangential plane being located on a circle with the diameter D. The diameter D corresponds to the formula $D=d_1+2R$ and is thus 14.5 mm. The deflector 10, which has a diameter $d_2$ of 12.5 mm, partially projects into the duct outlet opening 35 and forms a ring gap 31 with the interior wall of the latter. The yarn 30* leaving the nozzle is removed through the edge of the outlet opening.

As shown in FIGS. 4*a* and 4*b*, a support 33 with an axis 32 is attached to the housing 20 supporting the nozzle, and an arm 22 that is fixedly connected to the deflector 10 can be pivoted around said axis. By pivoting the arm 22, the ring gap 31 can be adjusted and/or the draw bar can be lifted off for the threading. The smooth yarn 30 is supplied to the texturing nozzle 1 by a delivery system 36 and removed as textured yarn 30* by a delivery system 37.

On the lower left, FIG. 5 shows purely schematically the texturing of the state of the art according to EP 0 088 254. It emphasizes two main parameters: an opening zone $Oe\text{-}Z_1$ as well as a shock front diameter $D_{AE}$ proceeding from a diameter d according to a nozzle as described in EP 0 088 254. In comparison, the texturing according to EP 0 880 611 is shown on the top right. It is clearly shown that the values $Oe\text{-}Z_2$ as well as $D_{AE}$ are greater. The yarn opening zone $Oe\text{-}Z_2$ starts shortly before the acceleration duct in the area of the compressed air supply P and is already clearly greater with respect to the relatively short yarn opening zone $Oe\text{-}Z_1$ of the solution according to EP 0 088 254. The essential statement of FIG. 5 is in the diagram comparison of the yarn tension according to the state of the art (curve T 311) with Mach<2 as well as a texturing nozzle in accordance with the invention (curve S 315) with Mach>2 and the new nozzle. On the perpendicular line of the diagram, the yarn tension is in CN. On the horizontal line, the production speed "Pgeschw." is shown in meters per minute. The curve T 311 shows the clear collapse of the yarn tension at a production speed of over 500 meters per minute. Above approximately 650 meters per minute, the texturing with the nozzle according to EP 0 088 254 collapsed. The curve S 315 with the appropriate nozzle from EP 0 880 611, on the other hand, shows that the yarn tension is not only much higher, but that it is also nearly constant in the range between 400 and 700 meters per minute and also drops only slowly in the higher production range. The increase of the Mach number is one of the most important parameters for the intensification of the texturing. The enlargement of the angle of introduction is of one of the most important parameters for the quality of texturing, as is shown with the new nozzle as third example on the top left. As an example, the angle of introduction is stated in the range of 50° to 60°. The yarn opening zone $Oe\text{-}Z_3$ is greater than in the solution on the top right (according to EP 0 880 611) and clearly greater than in the solution on the lower left (according to EP 0 088 254). The other procedural parameters are the same for all three solutions. In addition to the different angles of introduction in the range of 45° and 48° and new over 45°, the surprisingly positive effect is in the first segment of the yarn opening zone, as is in $OZ_1$ as well as $OZ_2$ and/or as marked in the appropriate circle. The outer difference is only in the change of the angle of introduction. The marked rise in the thread tension starts at an angle of over 48° and can be understood only with a combinatory effect. At least to the extent that the surprisingly positive effect is understood at this time, 48° angle of introduction represents a threshold, in particular for texturing nozzles in accordance with EP 0 880 611. This type of texture nozzle has a sufficient performance reserve so that even a slight intensification of the yarn opening is implemented into an increase in the yarn quality.

In practice, the textured yarn runs through a quality sensor after the second delivery system, such as the trademark name HemaQuality, called ATQ, for example, where the tensile force of the yarn 30* (in cN) as well as the deviation of the current tensile force (Sigma %) is measured. The measuring signals are supplied to a computer processor. The appropriate quality measurement is a condition for the optimum monitoring of the production. The values are also an indicator of the quality of the yarn. In the air blow texturing process, the determination of the quality is complicated in that there is no defined loop size. It is easier to determine the deviation from the quality that was assessed as good by the customers. This is possible with the ATQ system because the yarn structure and its deviation is determined by a thread tension sensor, evaluated, and displayed by a single number, the AT value. A thread tension sensor records as an analogue electrical signal in particular the tensile force of the thread after the texturing nozzle. The AT value is calculated continually from the mean value and the variance of the thread tensile force measuring values. The size of the AT value depends on the structure of the yarn and is determined by the user according to his own quality demands. If the tensile force of the thread or the variance (evenness) of the thread tension changes during the production, the AT value changes as well. The upper and lower limit values can be determined with yarn mirrors, knitting- and fabric samples. Depending on the quality demands, they will be different. The advantage of the ATQ measurement is that various types of problems in the process are determined simultaneously, such as, for example, equal positioning of the texturing, thread whetting, filament breaks, nozzle clogging, striking ball distance, hot pin temperature, differences in air pressure, POY plug zone, yarn feed, etc.

The following refers to the FIGS. 6*a* and 6*b*. The two figures show the "frame" for the core function in the generation of loop yarn. FIG. 6*a* proceeds from the solutions according to the FIG. 4*a* to 4*c*. FIG. 6*b* proceeds from the solution according to FIGS. 1, 2 and 3. The appropriate parts of the two figures have the same reference symbols. The two FIGS. 6*a* and 6*b* show the approximate size proportion of the individual areas for the core functions.

FIG. 6*a* shows concretely that the cylindrical segment zyl. A. is about twice as long as the enlargement segment EA. Three radial angle of introduction borings 15 are offset backward by a distance ö.A, the opening segment, relative to the enlargement segment EA and are located in the center area of the cylindrical segment, which is illustrated according to the angle of introduction segment (Einbl. A). In the enlargement segment EA, the diameter D as well as the radius R are very important. The cylindrical segment has a diameter Gd. Another important characteristic of the solution according to FIG. 6*a* is the angle α, which has an angle of approximately 48° in the direction of the transport of the yarn according to arrow 16. An introduction cone EK is required only long enough for the threading, but is very short. The diameter Bd is dimensioned according to the state of the art. A comparison of the FIGS. 4*a* and 6*a* shows concretely that the cylindrical segment (zyl. A) of the new solution is less than half as long compared to the solution of the state of the art according to FIG. 4*a*. This is an important characteristic in the specific embodiment of a ceramic nozzle core in accordance with the invention. From the view of the texturing function, the length of the yarn guide duct was designed unnecessarily long in the start of the art. The yarn guide duct Ga in the state of the art is dependent on the thickness measurement of the housing 20, as is clearly shown in FIG. 4*b*.

FIG. 6*b* shows two special characteristics compared to FIG. 6*a*. Instead of a trumpet-shaped segment EA, the solution according to FIG. 6*b* has a first conical segment (Kon. A) as well as a trumpet-shaped texturing segment TA* according to the solution of EP-PS 0 880 611. A comparison of the FIGS. 6*a* and 6*b* shows that the cylindrical segment "zyl. A* in FIG. 6*b* is developed shorter, according to the information X1 and X2. As a gain, the opening segment ö.Ä* is shown on an enlarged scale in FIG. 6*b*. The conical segment is preferably developed with an opening angle X of 12° to 40°. The second special characteristic is in the arrangement of the radial injection boring 15 with an angle β of preferably 50° to 70°, which raises the stability of the texturing to a very high level and allows the best texturing qualities.

FIG. 7 shows another especially advantageous embodiment, which proceeds from EP-PS 1 022 366. Practice shows that air blast texturing nozzles for the production of loop yarn have to be cleaned in relatively short time intervals. Thus, EP-PS 1 022 366 proposes to offset the nozzle core continuously or in alternating rotation. In this way, the cleaning interval could be extended massively. FIG. 7 shows how the new invention also can be used in a nozzle core driven by rotation. For this purpose, it is proposed to insert a two-part nozzle core, such as according to FIG. 2. FIG. 7 shows an example of the simultaneous connecting and texturing of two yarns, a yarn A and a yarn B, which are guided through a respective yarn guide 40 resp. 41 in the yarn introduction cone 6. The nozzle core, comprised of a ceramic nozzle core 24 as well as an outer nozzle core jacket 25, is arranged in a rotatably positioned rotary sleeve 42, which is positioned through ball bearings 43 in the drive housing 44. The compressed air is supplied through a compressed air chamber 45 as well as a compressed air connection 46, with the escape of compressed air being prevented by several seals 47. A worm wheel 48 is held by a collar 49 as well as a lid 50 in the drive housing 44. The drive is performed by a drive shaft 51, an overdrive wheel 52 as well as a worm wheel 48.

FIG. 8 shows in 3D-representation a nozzle core divided into two parts, corresponding to FIG. 6*a* and the FIGS. 3 and 7. FIG. 8 shows the assembly of a ceramic nozzle core 24 with an outer nozzle core jacket 25. The ceramic nozzle core 24 can be inserted manually into the nozzle core jacket 24, as indicated in FIG. 8, with the last insertion movement effecting a snap-like arrest 60 holding the ceramic nozzle core 24 exactly in position. Outwardly, a planar surface 34 corresponding to FIG. 2 is formed. A cylindrical compressed air chamber 61 is created between the ceramic nozzle body 24 and the outer nozzle core jacket, which is closed toward the outside by the seals 62 so that the compressed air can flow into the yarn duct 4 only through the radial angle of introduction borings 15.

The example according to FIG. 8 shows quite concretely another, very important characteristic of the new solution, i.e., the demand of the nearly constant wall strength of the ceramic nozzle core 24, with the wall strength being indicated with a respective measurement arrow at three places, WSt1, WSt2 and WSt3. For the demands of the installation, three different thicknesses are stated at the outer nozzle core jacket 25 with the measuring arrows D1, D2 and D3. Because the outer nozzle core jacket may be produced of synthetic material, for example, even very large variations in thickness do not have a negative effect. The inner ceramic nozzle core, on the other hand, can be produced optimally according to the demands for the production of ceramic blanks in the press method, in particular in the injection molding method.

FIG. 9 shows in section of the solution according to FIGS. 6*a* and 8.

FIG. 10 shows in section the FIGS. 6*b* and 8. In both figures, the ceramic nozzle core 24 is installed into the outer nozzle core jacket 25. According to another embodiment (not shown), the ceramic nozzle core 24 can be installed directly in to a housing 20, for example according to FIG. 4*b*. The housing 20 then would have to have fitting openings according to the miniaturized ceramic nozzle core 24.

The invention claimed is:

1. A nozzle assembly for generating loop yarn, said assembly comprising:

a ceramic nozzle core and an outer nozzle body; wherein the nozzle assembly is made of two parts, the outer nozzle body is configured to receive the ceramic nozzle core, and the ceramic nozzle core has an outer wall of substantially constant wall strength, and is sized to accommodate only a yarn treatment duct, an air injection structure, and a yarn outlet for the formation of loops.

2. The ceramic nozzle assembly of claim 1, including:

at least one cylindrical segment in fluid communication with an enlargement segment having a convexly arched outlet; and wherein the air injection structure is arranged within the cylindrical segment.

3. The ceramic nozzle assembly of claim 1, including:

at least one cylindrical segment, a conical segment having an opening angle of at least 12 degrees with respect to a longitudinal axis along a direction of transport of the yarn;

a trumpet-shaped enlargement segment; and wherein the cylindrical segment is in fluid communication with the conical segment, and the conical segment is in fluid communication with the trumpet-shaped enlargement segment, and the air injection structure is arranged within the cylindrical segment.

4. The ceramic nozzle assembly of claim 1, wherein the air injection structure includes at least one bore tilted at an angle of at least 48 degrees with respect to a longitudinal axis along a direction of transport of the yarn.

5. The ceramic nozzle assembly of claim 1, wherein the air injection structure includes at least one bore tilted at an angle ranging from 52 degrees to 65 degrees with respect to a longitudinal axis along a direction of transport of the yarn.

6. The nozzle assembly of claim 1, wherein the enlargement segment is configured to receive a spherical deflector.

7. The ceramic nozzle assembly of claim 6, wherein the outlet of the enlargement segment has a diameter equal to at least four times the diameter of the cylindrical segment.

8. The ceramic nozzle assembly of claim 3, wherein the air injection structure is arranged approximately in the center area of the longitudinal side of the cylindrical element of the ceramic nozzle core.

9. The ceramic nozzle assembly of claim 5, wherein the air injection structure includes three bores.

10. The ceramic nozzle assembly of claim 6, wherein the outlet of the enlargement segment has a diameter equal to at least 0.5 times the diameter of the spherical or semi-spherical deflector.

* * * * *